US011283230B2

(12) United States Patent
Frey et al.

(10) Patent No.: US 11,283,230 B2
(45) Date of Patent: Mar. 22, 2022

(54) DEVICE, METHOD, AND SYSTEM FOR INVERSE CRIMPING

(71) Applicant: Komax SLE GmbH & Co. KG, Grafenau (DE)

(72) Inventors: Werner Frey, Regen (DE); Ernst Lüftl, Fürstenstein (DE)

(73) Assignee: KOMAX SLE GMBH & CO. KG, Grafenau (DE)

( * ) Notice: Subject to any disclaimer, the term of this patent is extended or adjusted under 35 U.S.C. 154(b) by 218 days.

(21) Appl. No.: 16/466,477

(22) PCT Filed: Dec. 4, 2017

(86) PCT No.: PCT/EP2017/081400
§ 371 (c)(1),
(2) Date: Jun. 4, 2019

(87) PCT Pub. No.: WO2018/104242
PCT Pub. Date: Jun. 14, 2018

(65) Prior Publication Data

US 2020/0067252 A1 Feb. 27, 2020

(30) Foreign Application Priority Data

Dec. 5, 2016 (DE) ..... 10 2016 123 470.2

(51) Int. Cl.
*H01R 43/055* (2006.01)
*H01R 43/058* (2006.01)
(Continued)

(52) U.S. Cl.
CPC ..... *H01R 43/055* (2013.01); *H01R 4/20* (2013.01); *H01R 11/12* (2013.01); *H01R 43/058* (2013.01)

(58) Field of Classification Search
CPC ..... H01R 43/055; H01R 43/058
See application file for complete search history.

(56) References Cited

U.S. PATENT DOCUMENTS 3,018,816 A 1/1962 Cobaugh et al.
3,636,611 A 1/1972 Rosenbaum
(Continued)

FOREIGN PATENT DOCUMENTS

CN 101542851 A * 9/2009 ..... H01R 43/052
DE 1942399 A1 10/1970
(Continued)

OTHER PUBLICATIONS

English translation of the International Search Report dated Feb. 23, 2018 for parent application No. PCT/EP2017/081400.
(Continued)

*Primary Examiner* — Peter Dungba Vo
*Assistant Examiner* — Jose K Abraham
(74) *Attorney, Agent, or Firm* — J-TEK Law PLLC; Jeffrey D. Tekanic; Scott T. Wakeman

(57) ABSTRACT

A device (10) for inverse crimping a terminal (12), held on an infeed belt (24), onto a core (14) includes: a crimp anvil (16) that supports the terminal (12) during the crimping process, a crimper (18) that reshapes to-be-reshaped regions (20) of the terminal (12) supported on the crimp anvil (16) during the crimping process when the crimp anvil (16) and the crimper (18) move relative to each other, and an infeed-belt guide device (46) for guiding the infeed belt (24). During the crimping process, the crimp anvil (16) is moved together with the terminal (12) supported in or on the crimp anvil (16), and the infeed-belt guide device (46) is moved at least temporarily relative to the crimper (18) before and/or during the crimping process.

19 Claims, 6 Drawing Sheets

(51) Int. Cl.
*H01R 4/20* (2006.01)
*H01R 11/12* (2006.01)

(56) References Cited

U.S. PATENT DOCUMENTS

| | | | | |
|---|---|---|---|---|
| 3,685,148 | A | 8/1972 | Garfinkel | |
| 7,757,386 | B2 * | 7/2010 | Imgrut | H01R 43/055 29/753 |
| 2015/0047189 | A1 * | 2/2015 | Stull | H01R 43/0486 29/863 |
| 2017/0033525 | A1 * | 2/2017 | Backenstoes | H01R 43/055 |

FOREIGN PATENT DOCUMENTS

| | | | | |
|---|---|---|---|---|
| DE | 10357275 | A1 | | 7/2004 |
| FR | 1395498 | A | | 4/1965 |
| JP | 2001135447 | A | * | 5/2001 |
| JP | 2007026968 | A | * | 2/2007 |
| WO | 2008087938 | A1 | | 7/2008 |

OTHER PUBLICATIONS

English translation of the Written Opinion for parent application No. PCT/EP2017/081400.

* cited by examiner

DEVICE, METHOD, AND SYSTEM FOR INVERSE CRIMPING

CROSS-REFERENCE

This application is the U.S. national stage of International Application No. PCT/EP2017/081400 filed on Dec. 4, 2017, which claims priority to German patent application no. 10 2016 123 470.2 filed on Dec. 5, 2016.

TECHNICAL FIELD

The present disclosure relates to a device, a method, and a system for crimping or inverse crimping. Herein, the term "inverse crimping" means that a crimp anvil is moved, together with a terminal supported on the crimp anvil or guided in a cutting blade, toward a stationary crimper instead of the usual movement of a crimper that is moved toward a stationary crimp anvil with the terminal supported on the crimp anvil or guided in the cutting blade.

RELATED ART

When terminals (contact electrical terminals) are crimped onto multi-core cables, all terminals are usually produced in the so-called standard crimping geometry from one side (from above) (see FIG. 5B). However, for certain plug types, it can now be necessary to crimp the terminals onto the individual cores in relation to one another according to a predetermined orientation. For example, for a 4-core cable that is to be provided with B-crimp terminals, the two upper B-crimp terminals should be opened upward in the opened initial state, and the lower two B-crimp terminals should be opened downward (horizontal symmetry line) in the opened initial state.

Generally speaking, for this purpose all terminals are brought, with the same orientation, onto the cores (individual cables or wires) of a multi-core (multi-wire) cable. For example, for a four-core cable, two terminals are crimped, from above, onto the corresponding cores. The terminals are subsequently rotated by appropriate devices (or manually) to the desired positions, at which the mounting of a housing (plug housing) should take place. This subsequent rotating of the individual cores or terminals is more difficult the shorter the dismantling (sheath-removal) length of the jacket of the multi-core cable is. In order to avoid this difficulty, the cables together with cores are alternately inserted into the crimping device rotated about their longitudinal axis automatically or manually or the entire crimping device is rotated (in the above example, in pairs, the upper cores are first crimped and then, after a 180° rotation of the cable about its longitudinal axis, the lower cores are crimped).

SUMMARY

One non-limiting object of the present disclosure is to provide a device, a method, and a system for inverse crimping, using which device or method or system the formation of crimped multi-core cables having different orientations of the terminals can be simplified and improved.

Crimping devices described herein differ from standard crimping devices in that the crimp anvil is mounted on a movable part of the crimping device instead of on a stationary part, and the crimper is mounted on the stationary part of the crimping device instead of on the movable part. The crimp anvil and the crimper are thus mounted inversely with respect to a conventional crimping device. The movement, in or by which the crimping process is carried out, is still from above to below. In accordance with the inverse arrangement of the crimp anvil and of the crimper, the terminals are also fed or inserted into the crimping device rotated by 180° with respect to their longitudinal axis (inversely), i.e., opened downward. That is, they are fed or inserted into the crimping device such that they are opened downward in the opened initial state. Thus, the respective cores (cables), onto which the terminals are to be crimped, must also be fed or inserted into the crimping device below instead of above the terminal (inversely).

In the present disclosure, a terminal is preferably a metallic component that is preferably plastically deformable, and preferably at least partially electrically conductive.

In one preferred embodiment of the present teachings, the terminal has a crimp region on one side along its longitudinal direction and a contact region on the other side. During the crimping process, the crimp region is connected, preferably connected fixedly or in an interlocking manner, to a cable/conductor/cable-end or to a core by undergoing plastic deformation caused by the crimping device. The cable/conductor/cable-end or core is optionally provided with a ferrule. The contact region preferably forms a plug, a pin, or a socket. After the crimping process, the contact region can be mounted in a corresponding housing of a multi-pin plug.

In another preferred embodiment of the present teachings, the terminal does not include a contact region in the above sense; rather, in the uncrimped state it is an opened profile (tubular or V- or U-shaped) that, when crimping around the core, is closed (i) in a not completely overlapping manner, (ii) in a completely overlapping manner, or (iii) in a not completely closed manner. In this case, the terminal can preferably form a supporting ring, for example, for surrounding a jacket in the crimped state.

Each terminal is preferably crimped with (onto) a single wire or a single cable or a single core. The terminals mentioned herein preferably do not act to directly connect two cores within the to-be-reshaped region.

The terminals are preferably fed into the crimping device using an infeed belt. Preferably each terminal is held at least on one side on the infeed belt, wherein the connection between the infeed belt and the terminal is designed such that an easy separation or shearing-off of the terminal from the infeed belt is possible using (at) a predetermined breaking point without significant damaging or deforming of the terminal. The infeed belt is preferably metallic but can also be made of plastic. The terminal held on the infeed belt is preformed prior to the crimping process. If the terminal has a crimp region and a contact region, the contact region is preferably completely shaped or formed prior to the crimping process so that no further reshaping is necessary for later use, for example, as a plug or socket. The crimp region is preferably also preformed so that only a final and slight reshaping is necessary for connecting to the core, but at the same time insertion of the core is not unnecessarily hindered.

If the infeed-belt guide device is provided, it may be preferably designed or formed as a guide slot in the cutting blade. The cutting blade or the guide slot formed therein thus acts to guide the infeed belt. For this purpose, the guide slot is configured such that only the infeed belt is guided thereinto, and the terminal held on the infeed belt protrudes therefrom. The crimp anvil and the cutting blade are slidingly supported on each other. The terminal protrudes such that a support surface of the crimp anvil is in contact with the protruding terminal or can come into contact in a sliding relative movement between the terminal and the crimp anvil. As long as the terminal is not securely held between the crimper and the crimp anvil, the terminal is moved together with the crimp anvil toward the crimper while the terminal is held on the infeed belt that is guided in the guide slot. When the cutting blade abuts on a stop on the crimper or on a stop that is stationary with respect to the crimper, the terminal supported on the support surface of the crimp anvil is moved together with the crimp anvil farther toward the crimper while the cutting blade remains stationary. Due to the relative movement, the terminal is sheared off by the edge of the support surface that faces the cutting blade, or by a shearing edge provided on the crimp anvil near the support surface and the edge of the cutting blade that faces the crimp anvil.

The term "opened upward" means herein that the to-be-reshaped or reshaped regions of the crimp region of the terminal are disposed over the not-to-be-reshaped or not-reshaped regions and/or the core to be crimped with the terminal is inserted in the direction from above to below (i.e. vertically downward). Not-to-be-reshaped regions are regions of the crimp region that are not, or at least not significantly, reshaped during crimping. The not-to-be-reshaped regions preferably overlap with the to-be-reshaped regions perpendicularly to the longitudinal direction of the terminal (=longitudinal direction of the core). The term "opened downward" conversely means that the to-be-reshaped or reshaped regions of the terminal are disposed below the not-to-be-reshaped or not-reshaped regions and/or the core to be crimped with the terminal is inserted in the direction from below to above.

Crimping devices according to present teachings facilitate inverse crimping, i.e., crimping of terminals rotated by 180° with respect to the standard crimping device. In a crimping system comprising a standard (known) crimping device and an inverse crimping device as described herein, a first core of a multi-core cable can thus be provided, e.g., in the standard crimping device, with a first terminal in a first crimping process, and a second core of the multi-core cable can be provided, in the inverse crimping device according to the present teachings, with a second terminal that is rotated by 180° with respect to the first terminal, or vice versa, in a second crimping process without the multi-core cable having to be rotated about its longitudinal axis between the first and second crimping processes. The multi-core cable can therefore be continuously fixed or clamped, whereby the processing time is reduced and a high positional and locational accuracy of the multi-core cables with respect to the crimping device or the terminals is made possible.

The crimping process is preferably at least the process, in which by reshaping of the terminal the core is fixedly connected to the terminal or, by reshaping of the terminal, the terminal is fixedly connected to the core. Herein, the crimp anvil is preferably the tool that supports the terminal at least from above during the crimping process. Preferably the crimp anvil does not act directly to reshape the to-be-reshaped regions of the terminal; in particular the terminals to be crimped are preferably not opened toward the crimp anvil. The crimper is configured inversely thereto to reshape the to-be-reshaped regions (or at least a large part thereof) of the terminal supported on the crimp anvil in the crimping process during a relative movement between the crimp anvil and the crimper. The terminals to be crimped are preferably opened toward the crimper. In some embodiments it is not precluded that regions of the terminal are also reshaped by the crimp anvil. If terminals are used that are already "closed" in the initial state, the crimper is disposed on the side on which the overlap of the to-be-reshaped regions with respect to each other is increased or changed in the crimping process.

BRIEF DESCRIPTION OF THE DRAWINGS

Additional advantages, further developments, and other utilities of the present disclosure will become apparent upon reading the further description of the embodiments with reference to the Figures and the appended claims, in which:

DETAILED DESCRIPTION OF THE INVENTION

Figure 1:
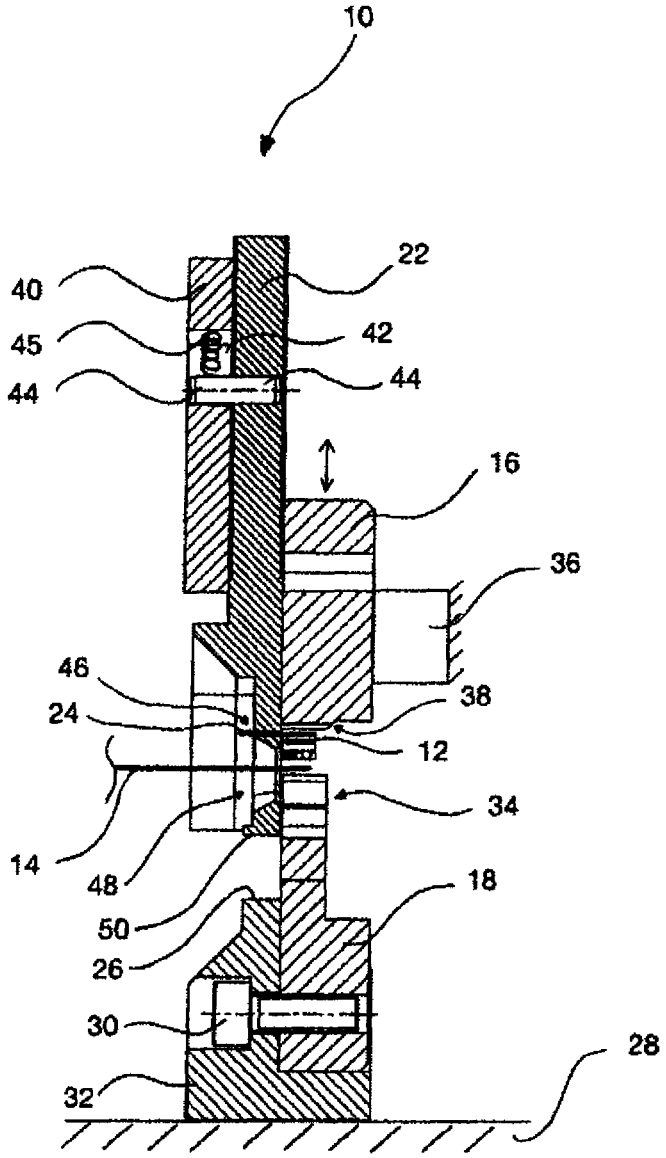
FIG. 1 shows a cross-sectional view of a crimping device for inverse crimping according to a first embodiment of the present teachings.

In the following a first embodiment of an inverse crimping device 10 is described with reference to FIG. 1, which shows a cross-sectional view thereof.

The inverse crimping device 10 includes a crimper 18 rigidly mounted, for example, on a base plate 28. In this embodiment the crimper 18 is attached to a pedestal (fixed base) 32, for example, by a screw 30; the pedestal 32 is mounted on the base plate 28.

As will be described below, the crimper 18 serves, in a crimping process, to reshape to-be-reshaped regions 20 of a terminal 12 supported on a crimp anvil 16 (see also FIG. 5A). For this purpose the crimper 18 includes, in the upper region, a crimper region 34 that is not depicted in detail. The crimper region 34 can be formed, for example, from V- or U-shaped projections that are adapted (conform) to the specific shape of the to-be-reshaped regions 20 of the terminal(s) 12. The crimper region 34 can be formed to reshape one single terminal 12 or multiple terminals 12 simultaneously. The pedestal 32 also includes a stop 26 in the upper region; here, the stop 26 is horizontally offset with respect to the crimper region. The function of the stop 26 will be described in further detail below.

A crimp anvil 16 is provided vertically above the crimper 18. The crimp anvil 16 is held so as to movable in the vertical direction by a drive unit 36. On its underside the crimp anvil 16 includes a support region (support surface) 38 that is not depicted in detail. The support region 38 lies opposite the crimper region 34 in the vertical direction and is configured to support a terminal 12 (from above).

The drive unit 36 is configured such that, to carry out the crimping process, the crimp anvil 16 is movable toward the crimper 18 from a first vertical position (rest position), at which it is spaced by a predetermined vertical distance with respect to (from) the crimper 18, to a second vertical position, at which the to-be-reshaped regions 20 of the terminal 12 are completely reshaped. In the second position the crimp anvil 16 and the crimper 18 can overlap, i.e. engage one-into-the-other, in the horizontal direction at least in the region of the support region 38 and of the crimper region 34. The drive unit 36 is, for example, an electric motor having a transmission (e.g., worm gear unit, rack and pinion drive, etc.) or a hydraulic or pneumatic drive. The drive unit includes a corresponding control unit.

The anvil 16 further includes a guide plate (guide means) 40 that is preferably fixedly attached, optionally via third (additional) components, to the anvil. The anvil 16 and the guide plate 40 are configured or attached to each other such that a cutting blade 22 is movably guided between them (only) vertically. For the vertical guiding of the cutting blade 22, the guide plate 40 includes a vertical slot 42, in which a guide bolt 44, which is fixedly attached to the cutting blade 22 and protrudes from the cutting blade 22, is guided in the vertical direction between an upper stop position and a lower stop position. The cutting blade 22 is thus movable between an upper and a lower stop position, wherein only the lower stop position is abutted and the upper stop position could be omitted. The cutting blade 22 is preferably preloaded (biased, urged) toward the lower stop position, for example, by a spring 45.

In the lower stop position, the cutting blade 22 is in its vertically lowest position with respect to or relative to the crimp anvil 16. In this lower stop position, the lower end of the cutting blade 22 protrudes downward from the anvil 16 toward the crimper 18 or toward the base plate 28. The support region 38 or the anvil 16 and the cutting blade 22 are configured such that the downwardly projecting portion of the cutting blade 22 is configured to be adjacent to the support region 38 in the horizontal direction (overlapping in the horizontal direction). In this embodiment the downwardly projecting portion in the first position of the crimp anvil 16 projects so far that it is also adjacent, at least in a section, to the crimper region 34, at least its upper end, in the horizontal direction (overlapping in the horizontal direction).

In the downwardly projecting portion of the cutting blade 22 on the side facing the anvil 16 (upper side, upper end region of the portion protruding downward), a preferably horizontal guide slot 46, which serves as an example of an infeed-belt guide device according to the present teachings, is provided for receiving an infeed belt (also referred to as contact strip) 24, which feeds the terminals 12. The guide slot is open on the side toward the crimp anvil. The infeed belt 24 is, for example, a metallic belt on which the terminals 12 are held on one side (at one end in their longitudinal direction). The guide slot 46 is provided such that, when the cutting blade 22 is in its lower stop position (and the crimp anvil is in its initial position (first position)), terminals 12 can be fed in a direction perpendicular to the drawing plane of FIG. 1 (horizontally) without colliding with the support region 38 of the anvil 16 or the crimper region 34 of the crimper 18. At least one terminal, which is held on the infeed belt, (i.e., not the infeed belt) protrudes here on the open side of the guide slot out of the guide slot into the region between crimp anvil and crimper (overlap region). Thus, only the infeed belt is located in the guide slot and only the terminal is located between the crimp anvil and the crimper.

In the protruding portion of the cutting blade 22, a core insertion opening 48 is also provided between the lower end (the end facing the crimper 18) of the cutting blade 22 and the guide slot 46. The core insertion opening 48 is preferably configured (shaped) in a conical manner, i.e. tapered from the side facing away from the anvil 16, and thus acts to easily insert a to-be-crimped core 14 with the terminal 12. As will be described below, the lower (outermost) end of the cutting blade 22 acts as a stop portion 50 of the cutting blade 22.

As will be described below with reference to FIGS. 2A to 2E, the above-described inverse crimping device 10 may be operated as follows. FIGS. 2A to 2E are based on FIG. 1 but do not show all above-described components for the sake of simplicity. Furthermore, not all reference numbers are indicated in all Figures.

Figures 2A, 2B, 2C, 2D, 2E:
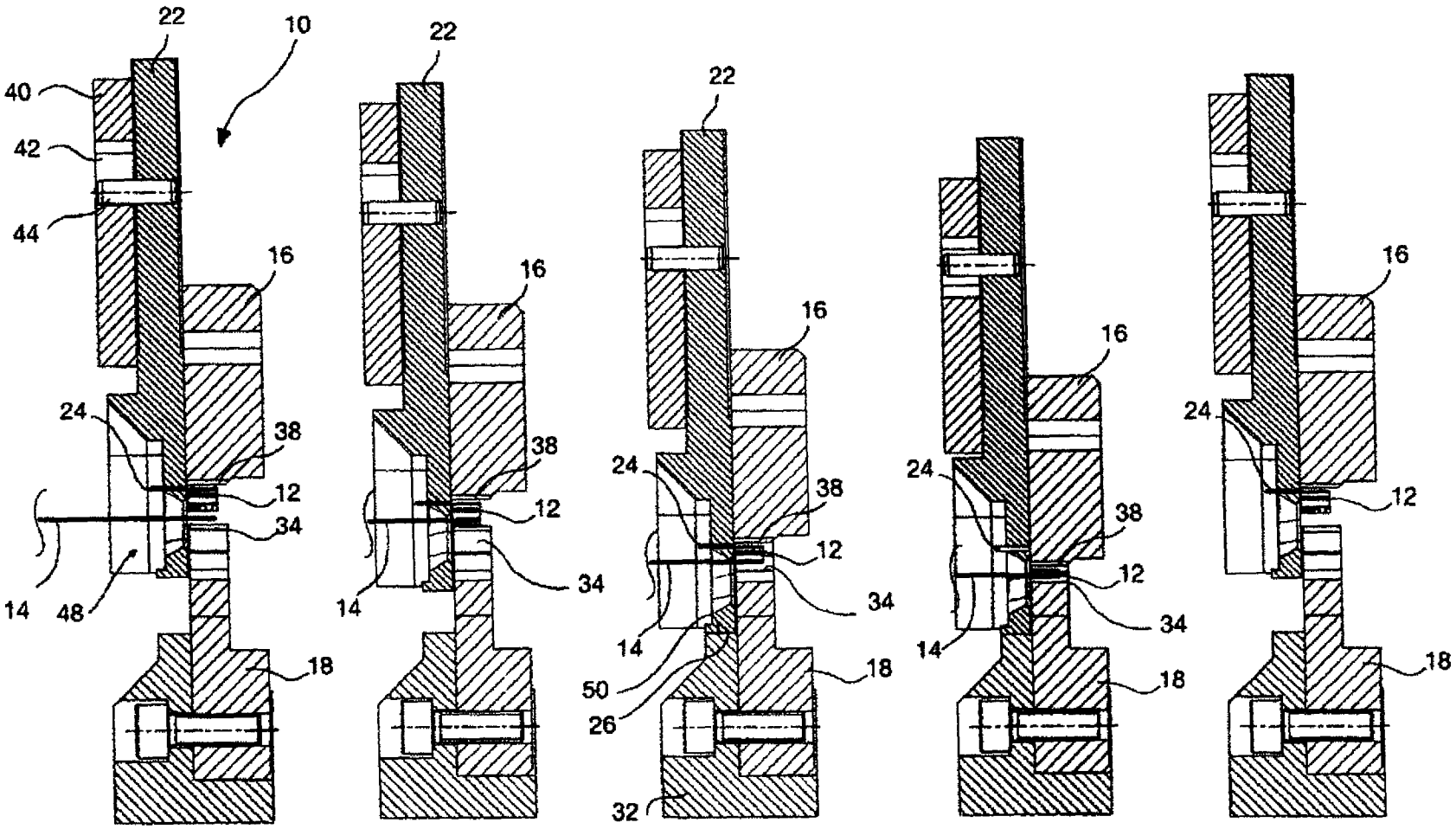
FIGS. 2A to 2E show partial-cross-sectional views of the device according to FIG. 1 in different positions during a crimping process.

In the initial state (rest position) of the inverse crimping device 10 shown in FIGS. 1 and 2A, the crimp anvil 16 is in its first vertical position (uppermost position), and the cutting blade 22 is in its lowermost position with respect to the anvil 16 (also the rest position or initial position, first position). Furthermore a terminal 12 has already been fed by the infeed belt 24 to a position between the crimp anvil 16 (in particular the support region 38 thereof) and the crimper 18 (in particular the crimper region 34 thereof). The terminal 12 is preferably very near or in abutment (in contact) with the support region 38.

Furthermore, the core 14, for example, of a multi-core cable, is introduced from left to right into the inverse crimping device 10, in particular into the core insertion opening 48, so far that the core 14 is disposed vertically below the terminal 12 and overlaps therewith (see also FIG. 1). The inverse crimping device 10 is thus configured such that the terminal 12 and the core 14 are accommodated vertically one-over-the-other in the vertical intermediate space between the support region 38 of the crimp anvil 16 and the crimper region 34 of the crimper 18.

As can be seen from a comparison of FIG. 2A with FIG. 2B, which shows a subsequent movement position, in a first step the crimp anvil 16 is now moved downward by the drive unit 36 (not shown here) toward the crimper 18 (toward the second vertical position of the crimp anvil 16). Since the cutting blade 22 is preloaded strongly enough downward by the spring 45 (not shown in FIGS. 2A-2E—see FIG. 1), the cutting blade 22 moves downward together with the crimp anvil 16. The infeed belt 24 guided in the guide slot 46 is thus also moved downward with the terminal 12 attached thereto. In the downward movement of the cutting blade 22, the core 14, which is inserted into the core insertion opening 48 and initially held in a core feed device not shown here and described below, comes into contact with the upper edge of the core insertion opening 48 and is also moved along downward. So that the core 14 will not be bent, the core feed device described below can be configured such that it allows an associated movement of the core 14 downward; i.e., the core feed device preferably descends together with the core 14. For this purpose a mechanical and/or electrical coupling or other type of coupling with the movement of the cutting blade can also optionally be provided. Furthermore, the crimper region 34 of the crimper 18 comes into contact with the terminal 12.

Starting from the position shown in FIG. 2B, as the crimp anvil 16 moves farther downward toward the crimper 18 (to the state shown in FIG. 2C), the crimper region 34 increasingly comes into contact with the to-be-reshaped regions 20 of the terminal 12, whereby the terminal 12 is increasingly firmly held between the support region 38 and the crimper region 34. In this progressive movement of the crimp anvil 16, a first plastic deformation of the to-be-reshaped regions 20 takes place, for example, which can lead to a first contact and at least partial surrounding of the core 14 by the terminal 12. During this movement in this embodiment, the crimper region 34 increasingly comes into overlap (horizontal) with the support region 38. The core 14 is moved farther downward, owing to the abutment on the upper edge of the core insertion opening 48, in association with the movement of the cutting blade 22.

In FIG. 2C a position is reached at which the terminal 12 is securely held between the crimper region 34 and the support region 38. There is therefore no longer a need for the terminal 12 to be held on the infeed belt 24. For this reason the cutting blade 22, in particular its stop portion 50, and the pedestal 32 or the stop 26, are configured and disposed with respect to each other such that, at the position shown in FIG. 2C, the stop portion 50 of the cutting blade 22 comes into contact with the stop 26 that is provided on the pedestal 32 of the crimper 18.

As the crimp anvil 16 moves further onto the crimper 18 (to the second vertical position shown in FIG. 2D), the cutting blade 22 can thus no longer be moved associatively together with the crimp anvil 16. Instead, the further movement of the crimp anvil 16 onto the crimper 18 results in a relative movement between the crimp anvil 16 and the now stationary (no longer associatively moved) cutting blade 22 to a second position, which leads to a shearing-off of the terminal 12 from the infeed belt 24. In other words, the terminal 12 together with the core 14 inserted therein is moved farther downward with the crimp anvil 16, whereas the infeed belt 24 guided in the cutting blade 22 is not moved downward, which leads to the shearing-off. Here the shearing-off preferably occurs between the lower right edge (the edge closer to the crimper and facing the crimp anvil) of the guide slot and the edge of the support region of the crimp anvil that faces the cutting blade. Alternatively a special shearing edge can also be provided on the cutting blade and/or on the crimp anvil.

As the crimp anvil 16 moves to the second vertical position shown in FIG. 2D, i.e., as the crimp anvil 16 moves relative to the crimper 18, the completion of the crimping process preferably also occurs (simultaneously). The core 14 comes out of engagement with the upper edge of the core insertion opening 48, and the to-be-reshaped regions 20 are (plastically) reshaped into their final crimped position. Thus, the core 14 is moved downward together with the terminal 12 in the downward movement of the crimp anvil 16. The core 14 and the terminal 12 are now fixedly connected to each other (crimped).

In the next step the crimp anvil 16 is moved back upward, whereby first the crimped terminal 12 is released and can be removed, for example, leftward together with the core 14. After the return of the crimp anvil 16 and the corresponding return of the cutting blade 22 into their initial positions, a new terminal 12 already can be fed via the infeed belt 24, as shown in FIG. 2E.

The term "crimping process" herein should be understood in particular to mean the movement by which the actual crimping (reshaping) of the terminal on the core is effected. The movement of the crimp anvil from the first position to the second position is thus essentially meant here.

Figure 3:
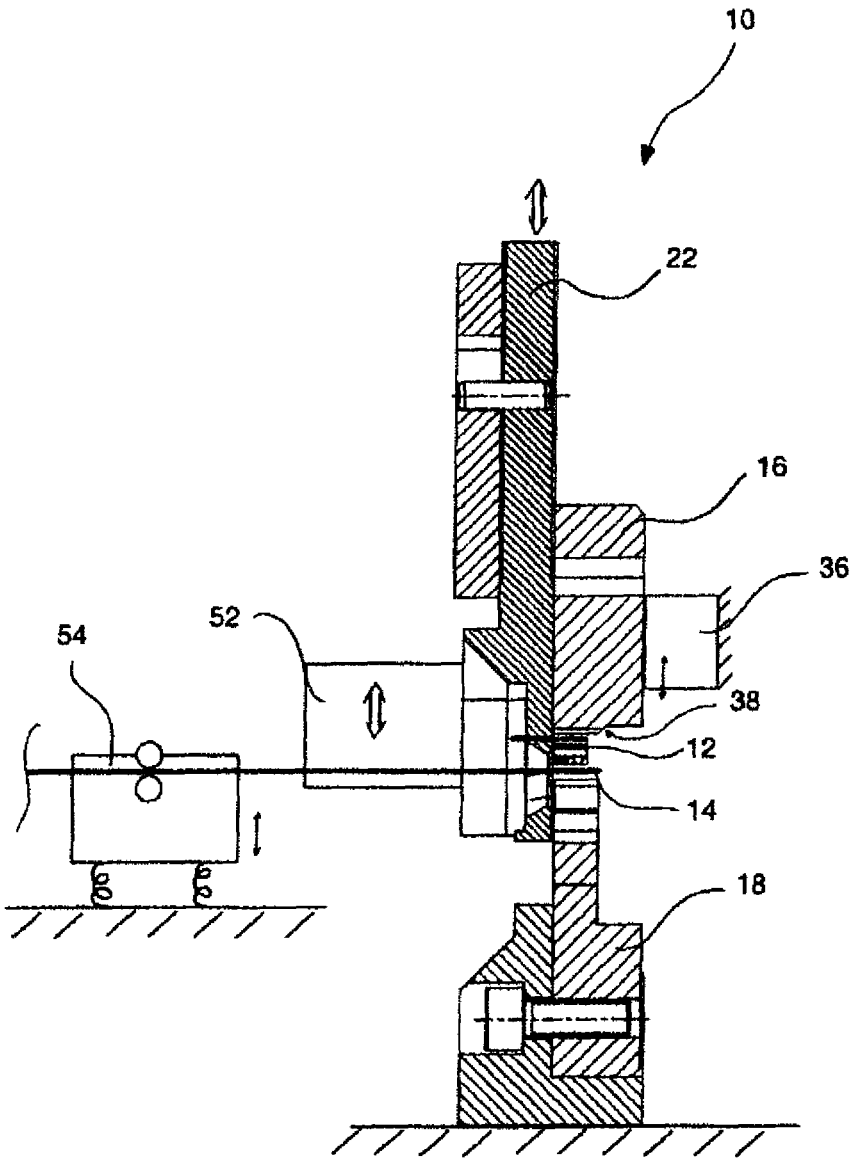
FIG. 3 shows a cross-sectional view of a device for inverse crimping according to a second embodiment of the present teachings.

FIG. 3 shows a further embodiment of the crimping device in which, in addition to the features described up to now, an infeed-belt transport device 52 and a core feed device (also referred to as core- or cable-clamping device) 54 are provided.

The infeed-belt transport device 52 acts to feed the infeed belt 24 to the cutting blade 22. For example, the infeed-belt transport device 52 includes two rollers, of which at least one is rotationally driven by an electric motor controlled by a control unit; the infeed belt 24 is transported between the two rollers. The infeed belt 24 is preferably configured as a perforated belt so that a corresponding gear ring can perform the transport or advancing and can ensure the exact positioning. In this embodiment the infeed-belt transport device 52 is rigidly connected to the cutting blade 22 such that, during the vertical movement of the cutting blade 22 together with the crimp anvil 16, an associated movement of the infeed-belt transport device 52 also occurs. A step motor is preferably used to enable the discontinuous (step-wise) feeding.

The core feed device 54 acts to feed and position the core 14 in the inverse crimping device 10. In particular, it makes possible an exact positioning, at least in the longitudinal direction of the core, of the to-be-crimped part of the core at a predetermined relative position with respect to the terminal. For example, the core feed device 54 includes two rollers or rolls, of which at least one is rotationally driven by an electric motor controlled by a control unit; the core 14 is transported and clamped by the rollers or rolls. Preferably the multi-core cable associated with the respective core is transported and positioned using the core feed device 54, and only a predetermined number of cores are inserted into the crimping device and optionally transported out again after the crimping.

In this embodiment the core feed device 54 is vertically movable, for example, by springs so that a downward movement of the core feed device 54 also takes place with the above-described downward movement of the crimp anvil 16 between the position, in FIG. 2B and FIG. 2D, of the core 14 located in the terminal 12. A possible position change of the core due to a relative-position change between core feed device 54 and crimp anvil 16 is thereby avoided. The core feed device 54 can also be rigidly attached to the crimp anvil 16 or mechanically coupled to the crimp anvil. Alternatively a movement controlled by sensors can also be considered.

The support of both the infeed-belt transport device 52 and the core feed device 54, which is movable relative to the surroundings, thus acts to reduce forces that result from the movement of the crimp anvil 16 or of the cutting blade 22 during the crimping process. The infeed-belt transport device 52, the core feed device 54, and the drive unit 36 can be controlled centrally or non-centrally and optionally can be networked with one another.

Figure 4:
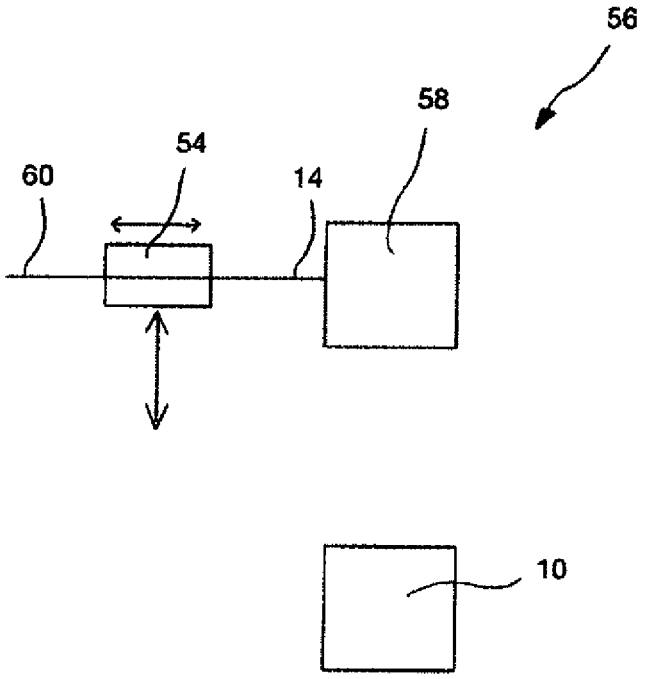
FIG. 4 shows a plan view of a schematically depicted crimping system including a further-developed crimping device according to the second embodiment.

FIG. 4 shows a plan view of a crimping system 56 that includes, in addition to the inverse crimping device 10 shown in FIG. 3, a further conventional crimping device 56. The conventional crimping device 58 differs from the above-described inverse crimping device 10 in particular in that the crimp anvil is provided at the location/position of the crimper and the crimper is provided at the location/position of the crimp anvil. The individual functions assigned to these components remain identical here. A terminal which, in contrast to the above inverse crimping device 10 is opened upward, is thus fed into the crimp anvil via an infeed belt. A core is subsequently inserted from above to below into the terminal (using a core feed device 54) and the crimping of the terminal onto the core is effected by moving the crimper from above to below toward the crimp anvil (here the crimper is driven via a drive unit (not depicted separately)).

Furthermore, in the depicted crimping system 56, preferably only a single core feed device (here also cable feed device) 54 is provided, which is preferably configured to be movable in a controlled manner (preferably by a drive (electric motor)) horizontally (in the drawing plane) in two directions, so that at least one core 14 of a multi-core cable 58 can be fed to both the conventional crimping device 58 and the inverse crimping device 10. Alternatively the crimping devices 10, 56 can be configured to be movable.

In particular, a terminal 12 opened upward can be crimped onto a first core 14 of a multi-core cable using the conventional crimping device 58, and a terminal 12 opened downward can be crimped onto a second core of the same multi-core cable 60 using the above-described inverse crimping device 10. In this case, the cable or cores need not be rotated about their longitudinal axis between the crimping processes.

Each of the crimping devices 10, 56 shown in FIG. 4 is preferably configured for simultaneous crimping of two terminals (each of the two opened upward or downward). For example, two cores 14 of a four-core cable 60 are thus fed into the crimp anvil of the conventional crimping device 58 using the core feed device 54 and simultaneously provided with upwardly opened terminals. The crimped cores are subsequently removed (extracted) from the conventional crimping device 58 by the movable core feed device 54 and positioned in the second inverse crimping device 10. The crimping of the inversely, downwardly opened terminals occurs in the second inverse crimping device 10.

Figure 5A:
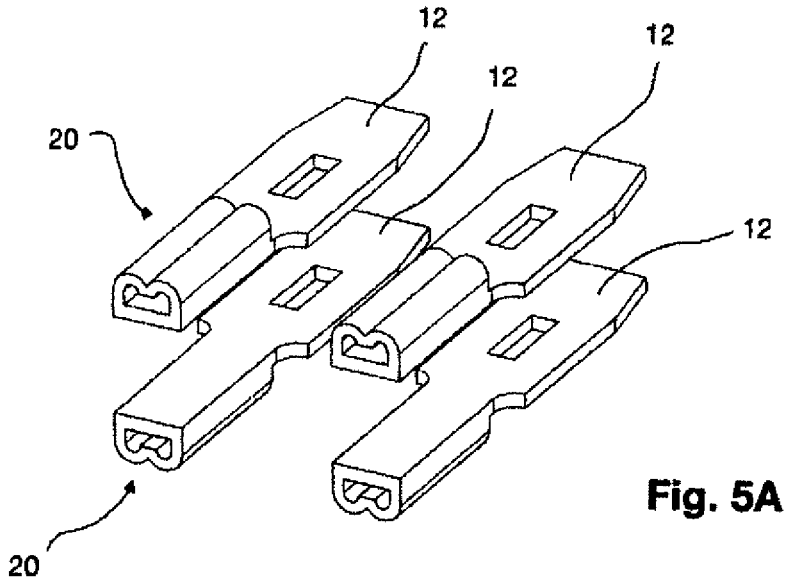
FIG. 5A shows a view of a geometrical arrangement of terminals that can be manufactured using the crimping device or the crimping system according to the present disclosure.
Figure 5B:
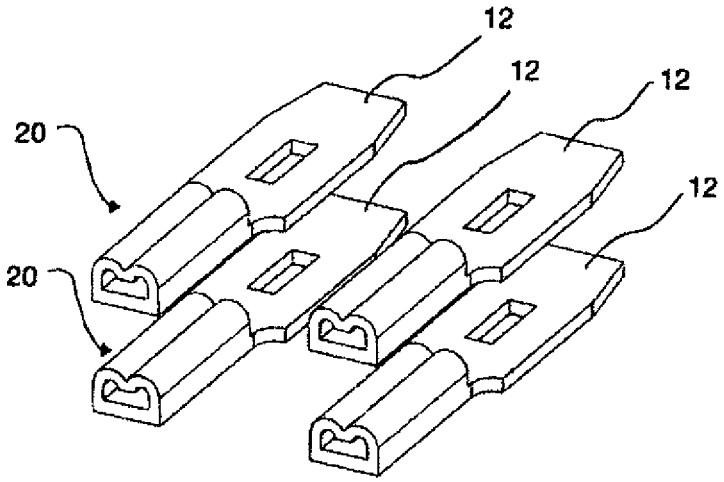
Fig. 5B PRIOR ART
FIG. 5B shows a view of a geometrical arrangement of known terminals that can be manufactured using crimping devices known in the prior art.

Such a crimping system makes possible the formation of the four terminals shown in FIG. 5A, of which two are opened upward and two downward, without the multi-core cable 60 or individual cores 14 held (clamped) in the core feed device 54 having to be rotated about their longitudinal axis. A simpler, more efficient, and more secure (precise) production process is thereby ensured.

Figure 6:
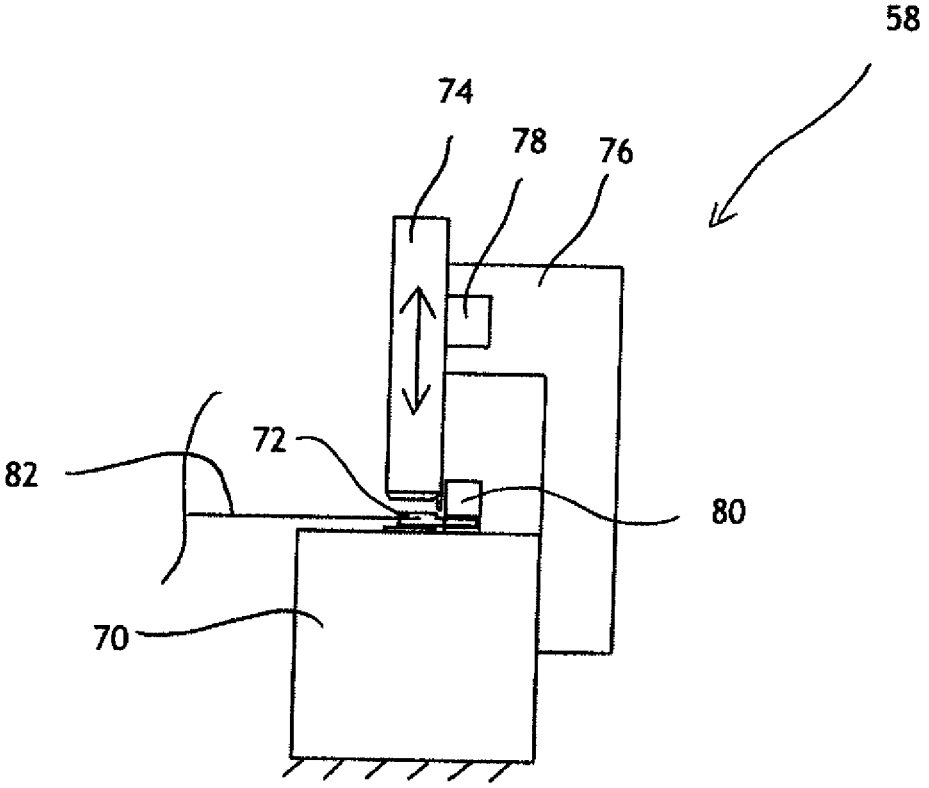
Fig. 6 PRIOR ART
FIG. 6 shows a cross-sectional view of a conventional (known) crimping device.

A possible example of a conventional crimping device 58, which can be used in the above-described crimping system 56, is depicted in a simplified manner in FIG. 6. As can be seen from FIG. 6, the crimp anvil 70 is disposed in a stationary manner with respect to the surroundings, e.g., its fixed base. The crimper 74 is held on the crimp anvil 70 by a carrier 76, wherein the crimper 74 is movable toward the crimp anvil 70 and in the opposite direction by a drive unit 78 that can be configured like the drive unit 36. A fixed guide device 80 serves to feed and/or transport an infeed belt on which the terminal 72 is held. Before the actual crimping process, a terminal is fed between the crimper and the crimp anvil such that the terminal is opened upward. A feeding (inserting) of a core 82 into the opened terminal subsequently occurs. In the actual crimping process, the crimper is lowered toward the crimp anvil by the drive unit so that the terminal is connected by deformation to the core. A separating of the terminal from the infeed belt can be effected before, or simultaneously with, the crimping process using a cutting edge provided on the crimper.

In addition, further possible designs of the inverse crimping device or of the crimping system are described below, which if not in conflict can be combined with the above-described features and/or serve to exchange therewith.

Instead of the guiding using the guide plate 40, the cutting blade 22 can also be movably guided on the crimp anvil 16 in the vertical direction in any other suitable manner. The stop positions of the cutting blade 22 can also be formed by correspondingly integrally formed recesses in the cutting blade 22 and/or in the crimp anvil 16. In addition, the upper stop position of the cutting blade can be omitted, since this is not relevant for the functioning of the device.

The preload of the cutting blade 22 to its lower position with respect to the crimp anvil 16 can also be effected by hydraulic, electrical, or other types of actuators instead of by a spring. Alternatively it can be sufficient that the cutting blade 22 is "preloaded" by its own weight force and is moved downward associatively with the crimp anvil.

The above-described sequence (movement downward of the crimp anvil with the terminal→contact of the terminal with the core→contact of the to-be-reshaped regions with the crimper region, etc.) can also be modified as long as the function (effect) of the crimping is ensured.

As already explained, the inverse crimping device or the crimping system can be configured for simultaneous crimping of a plurality of cores. The cutting blade can accordingly also include one or more insertion openings or one single insertion opening configured for the insertion of a plurality of cores.

In the examples shown in the Figures, the terminals are crimped-on only onto the ends of the cores. Alternatively the terminals can be crimped-on onto any regions of the cores or also on a plurality of cores.

Although only B-crimp terminals are shown in the Figures, any kind of crimpable terminals, such as, for example, C-crimp terminals, can be used.

The movement of the crimp anvil is not limited to an upward-downward movement. Rather, the movement can occur in any (horizontal/vertical) direction, as long as a relative movement with respect to the crimper (toward the crimper) is achieved.

The above-described movement processes or sequences, when which component comes into contact or enters into interaction with which component, can of course be modified. For example, the core can already come into contact with the terminal upon insertion and/or the terminal can also already be in contact with the crimp anvil after the feeding of the terminal. Furthermore, the reshaping of the terminal can also occur only after or during the shearing-off of the terminal from the infeed strip.

Further aspects of the present disclosure include but are not limited to:

Aspect 1: Device (10) for inverse crimping of a terminal (12) onto a core (14), including a crimp anvil (16) that is configured to support the terminal (12) during the crimping process, a crimper (18) that is configured to reshape to-be-reshaped regions (20) of the terminal (12) supported on the crimp anvil (16) in the crimping process in a relative movement between the crimp anvil (16) and the crimper (18), wherein during the crimping process the crimp anvil (16) is moved together with the terminal (12) supported in or on the crimp anvil (16).

Aspect 2: Device (10) for inverse crimping of a terminal (12) onto a core (14), including a crimp anvil (16), a crimper (18), wherein the crimper (18) is provided vertically below the crimp anvil (16), and during the crimping process the crimp anvil (16) is moved toward the crimper together with the terminal (12) supported in or on the crimp anvil (16).

Aspect 3: Device (10) for inverse crimping of a terminal (12) onto a core (14), including a crimp anvil (16), a crimper (18), wherein the crimp anvil (16) and the crimper (18) are configured such that the core (14) and the terminal (12) are disposable in an intermediate space between the crimp anvil (16) and the crimper (18), wherein the crimp anvil (16), the terminal (12), the core (14), and the crimper (18) are disposed overlapping in one direction in this order, and during the crimping process the crimp anvil (16) is moved toward the crimper together with the terminal (12) supported in or on the crimp anvil (16).

Aspect 4: Device according to one of aspects 1 to 3, wherein the crimper (18) is configured such that during the crimping process it is stationary with respect to the surroundings and/or the crimp anvil (16) is moved relative to the crimper (18), and/or in the crimping process the crimp anvil (16) is moved toward the crimper (16) from a first position to a second position.

Aspect 5: Device according to one of aspects 1 to 4, which further includes a cutting blade (22), using which the terminal (12) held in an infeed belt (24) is separable from the infeed belt (24), wherein the cutting blade (22) for separating the terminal (12) is movable with respect to the crimp anvil (16) between a first position, at which the terminal (12) is held on the infeed belt (24) between the crimp anvil (16) and the crimper (18), and a second position, at which the terminal (12) is supported on the crimp anvil (16) and separated from the infeed belt (24).

Aspect 6: Device according to aspect 5, wherein in the first position the cutting blade (22) is in its lowest position with respect to the crimp anvil, and/or in the first position and/or prior to reaching the second position of the crimp anvil (16) the terminal (12) is supported on the crimp anvil (16), and/or the cutting blade (22) is guided on the crimp anvil (16).

Aspect 7: Device according to aspect 5 or 6, wherein a stop (26) that is stationary with respect to the crimper (18) is provided for the cutting blade (22), wherein the cutting blade (22) and the stop (26) are configured such that the cutting blade (22) that is located in the first position with respect to the crimp anvil (16) abuts on the stop (26) in the relative movement of the crimp anvil (16) toward the crimper (18), whereby the terminal (12) is separated from the infeed belt (24) in the further relative movement of the crimp anvil (16) toward the crimper (18) due to the resulting relative movement between the crimp anvil (16) and the cutting blade (22) to the second position.

Aspect 8: Device according to aspect 7, wherein in the state in which the cutting blade (22) comes into contact with the stop (26) in the relative movement of the crimp anvil (16) on the crimper (18), the terminal (12) is fixed between the crimp anvil (16) and the crimper (18).

Aspect 9: Device according to one of aspects 1 to 8, wherein the crimp anvil (16) and the crimper (18) are configured such that the terminal (12) to be crimped and inserted into the device is opened toward the crimper (18) prior to the crimping process, and/or the crimp anvil (16) and the crimper (18) are configured such that the core (14) and the terminal (12) are disposable in an intermediate space between the crimp anvil (16) and the crimper (18), wherein the crimp anvil (16), the terminal (12), the core (14), and the crimper (18) are disposed overlapping in one direction in this order, and/or the crimp anvil (16) is disposed vertically above the crimper (18).

Aspect 10: Crimping system for inverse crimping of two terminals (12) on two cores (14) of a multi-core cable (60), including a first device (58) for crimping a terminal (12) onto a core (14), which first device (58) includes a crimp anvil that is configured to support the terminal during the crimping process, a crimper that is configured to reshape to-be-reshaped regions of the terminal supported on the crimp anvil in the crimping process in a relative movement with respect to the crimper, wherein the crimp anvil with the terminal supported in the crimp anvil is stationary with respect to the surroundings during the crimping process, and during the crimping process the crimper is moved relative to the crimp anvil, and a second device (10) for inverse crimping of a terminal according to one of aspects 1 to 9, wherein the first terminal (12) is crimped onto the first core by the first crimping device (58), the second terminal (12) is crimped onto the second core (14) by the second crimping device (10), and the multi-core cable is not rotated about its longitudinal axis between the first crimping process and the second crimping process.

Aspect 11: Method for inverse crimping of a terminal (12) onto a core (14), including the following steps:

providing of a terminal (12) and a core (14) onto which the terminal (12) is to be crimped, moving of a crimp anvil (16), together with the terminal (12) and the core (14) to be crimped, toward a crimper (18).

Aspect 12: Method according to aspect 11, wherein upstream or downstream a further terminal is crimped onto a further core by moving a crimper together with the terminal (12) and the to-be-crimped core (14) toward a crimp anvil, wherein the multi-core cable is not rotated about its longitudinal axis between the first crimping process and the second crimping process.

Aspect 13: Device (10) for inverse crimping of a terminal (12) onto a core (14), wherein the terminal (12) held on an infeed belt (24) is fed to the device (10), including a crimp anvil (16) that is configured to support the terminal (12) during the crimping process, a crimper (18) that is configured to reshape to-be-reshaped regions (20) of the terminal (12) supported on the crimp anvil (16) in the crimping process in a relative movement between the crimp anvil (16) and the crimper (18), an infeed-belt guide device (46) for guiding the infeed belt (24), wherein during the crimping process the crimp anvil (16) is preferably moved or is movable together with the terminal (12) supported in or on the crimp anvil (16), and the infeed-belt guide device (46) is moved or is movable at least temporarily relative to the crimper (18) before and/or during the crimping process.

Aspect 14: Device (10) for inverse crimping of a terminal (12) onto a core (14), which terminal (12), held on an infeed belt (24), is fed to the device (10), which device (10) includes a crimp anvil (16), a crimper (18), and an infeed-belt guide device (46), wherein the crimper (18) is provided vertically below the crimp anvil (16), and during the crimping process the crimp anvil (16) is moved toward the crimper preferably together with the terminal (12) supported in or on the crimp anvil (16), and the infeed-belt guide device (46) is moved or is movable at least temporarily toward the crimper (18) before and/or during the crimping process.

Aspect 15: Device (10) for inverse crimping of a terminal (12) onto a core (14), which terminal (12), held on an infeed belt (24), is fed to the device (10), which device (10) includes a crimp anvil (16), a crimper (18), and an infeed-belt guide device (46), wherein the crimp anvil (16) and the crimper (18) are configured such that preferably the core (14) and the terminal (12) held on the infeed belt (24) are disposable in an intermediate space between the crimp anvil (16) and the crimper (18), wherein the crimp anvil (16), the terminal (12), the core (14), and the crimper (18) are disposed or disposable overlapping in one direction in this order, during the crimping process the crimp anvil (16) is moved or is movable toward the crimper (18) together with the terminal (12) supported in or on the crimp anvil (16), and the infeed-belt guide device (46) is moved or is movable at least temporarily toward the crimper (18) before and/or during the crimping process.

Aspect 16: Device according to one of aspects 13 to 15, wherein the crimper (18) is configured such that during the crimping process it is stationary or rigid with respect to the surroundings and/or the crimp anvil (16) is moved relative to the crimper (18), and/or in the crimping process the crimp anvil (16) is moved toward the crimper (18) from a first position, at which it does not contact the terminal, to a second position, at which the crimping of the terminal onto the core is completed and the crimp anvil contacts the terminal, wherein the first position is preferably the position at which the crimp anvil is farthest from the crimper, and the second position is the position at which the crimp anvil is the closest to the crimper.

Aspect 17: Device according to one of aspects 13 to 16, which further includes a cutting blade (22), using which the terminal (12) held in the infeed belt (24) is separable from the infeed belt (24), wherein the infeed-belt guide device is provided in or on the cutting blade in the form of a guide slot (46), in which the infeed belt is guided, and the cutting blade (22) for separating the terminal (12) is movable with respect to the crimp anvil (16) between a first position, at which the terminal (12) is held or holdable on the infeed belt (24) (i.e., in the not-yet-separated-from-the-infeed-belt-state) between the crimp anvil (16) and the crimper (18), and a second position, at which the terminal (12) is supported on the crimp anvil (16) and separated or can be separated from the infeed belt (24).

Aspect 18: Device according to aspect 17, wherein in the first position with respect to the crimp anvil, the cutting blade (22) or the infeed-belt guide device is in its lowest position, and/or in the first position and/or prior to reaching the second position of the crimp anvil (16), the terminal (12), preferably held on the infeed belt, is supported on the crimp anvil (16), and/or the cutting blade (22) or the infeed-belt guide device is guided on the crimp anvil (16).

Aspect 19: Device according to aspect 17 or 18, wherein a stop (26) that is stationary with respect to the crimper (18) is provided for the cutting blade (22), wherein the cutting blade (22) and the stop (26) are configured such that the cutting blade (22) that is located in the first position with respect to the crimp anvil (16) is moved toward the stop (26) and abuts on the stop (26) in the relative movement of the crimp anvil (16) toward the crimper (18), whereby in the further relative movement of the crimp anvil (16) toward the crimper (18) the terminal (12) is separated from the infeed belt (24) due to the resulting relative movement between the crimp anvil (16) and the cutting blade (22) to the second position of the cutting blade (22).

Aspect 20: Device according to aspect 19, wherein in the state in which the cutting blade (22) comes into contact with the stop (26) in the relative movement of the crimp anvil (16) on the crimper (18), the terminal (12) is fixed between the crimp anvil (16) and the crimper (18).

Aspect 21: Device according to one of aspects 13 to 20, wherein the crimp anvil (16) and the crimper (18) are configured such that the terminal (12) to be crimped and inserted into the device is opened toward the crimper (18) prior to the crimping process, and/or the crimp anvil (16) and the crimper (18) are configured such that the core (14) and the terminal (12) are disposable in an intermediate space between the crimp anvil (16) and the crimper (18), wherein the crimp anvil (16), the terminal (12), the core (14), and the crimper (18) are disposed overlapping in one direction in this order, and/or the crimp anvil (16) is disposed vertically above the crimper (18).

Aspect 22: Crimping system for inverse crimping of two terminals (12) on two cores (14) of a multi-core cable (60), including a first device (58) for crimping a terminal (12) onto a core (14), which includes a crimp anvil that is configured to support the terminal during the crimping process, a crimper that is configured to reshape to-be-reshaped regions of the terminal supported on the crimp anvil in the crimping process in a relative movement with respect to the crimper, wherein the crimp anvil with the terminal supported in the crimp anvil is stationary with respect to the surroundings during the crimping process, and during the crimping process the crimper is moved relative to the crimp anvil, and a second device (10) for inverse crimping of a terminal according to one of aspects 13 to 21, wherein the first terminal (12) is crimped onto the first core by the first crimping device (58), the second terminal (12) is crimped onto the second core (14) by the second crimping device (10), and between the first crimping process and the second crimping process the multi-core cable is not rotated about its longitudinal axis. The direction of movement of the crimp of the first device during crimping is thus preferably the same as the direction of movement of the crimp anvil of the second device. The crimper of the first device is preferably disposed above the corresponding crimp anvil, while in the second device the crimp anvil is preferably disposed above the crimper. The first device preferably includes a drive unit (78), using which the crimper can be moved toward the crimp anvil in the crimping process.

Aspect 23: Method for inverse crimping of a terminal (12) onto a core (14), including the following steps:

providing and feeding of a terminal (12) held on an infeed belt, providing a core (14) onto which the terminal (12) is to be crimped, simultaneous moving of a crimp anvil (16) and an infeed-belt guide device (46), in which the infeed belt (24) is guided, together with the terminal (12) toward a crimper (18).

Aspect 24: Method according to aspect 23, wherein upstream or downstream a further terminal is crimped onto a further core by moving a crimper together with the terminal (12) and the to-be-crimped core (14) toward a crimp anvil, wherein the multi-core cable is not rotated about its longitudinal axis between the first crimping process and the second crimping process.

Aspect 25: Device or method according to one of the preceding aspects, wherein the terminal (12) is preformed, and/or the terminal (12) includes a crimp region wherein the to-be-reshaped and not-to-be-reshaped regions are disposed and a contact region that forms a plug, pin, or a socket.

Aspect 26: Device or method according to one of the preceding aspects, wherein in a first phase of the movement of the crimp anvil (16) from the first position to the second position on the crimper (18), no relative movement takes place between the infeed-belt guide device (46) and the crimp anvil (16), and/or in a second phase of the movement of the crimp anvil (16) from the first position to the second position on the crimper, no relative movement takes place between the infeed-belt guide device (46) and the crimper (18).

Aspect 27: Device or method according to aspect 26, wherein in the second phase of the movement a separating of the terminal (12) from the infeed belt (24) takes place, and/or the crimping process takes place in the first and second phase or only in the second phase, and/or the crimping process is completed with the end of the second phase.

Aspect 28: Device according to one of the preceding aspects, wherein the crimp anvil and the infeed-belt guide device or the cutting blade are guided against each other, and the infeed-belt guide device or the cutting blade are preloaded with respect to the crimp anvil toward the crimper, for example, by a spring, and at the end of the first phase of the movement or in the transition to the second phase of the movement the infeed-belt guide device or the cutting blade abut on a stop 26 that is stationary with respect to the crimper so that, in the further movement of the crimp anvil (in the second phase), the spring is compressed by the relative movement between crimp anvil and the infeed-belt guide device or the cutting blade. Alternatively the infeed-belt guide device or the cutting blade can be driven via a separate drive device, wherein in this case the movement sequence according to aspect 26 is also observed.

The disclosure also comprises a crimping system that is comprised of the disclosed devices and an infeed belt including terminals and/or one or more cores. It is explicitly emphasized that all of the features disclosed in the description and/or the claims should be considered as separate and independent from one another for the purpose of the original disclosure as well as for the purpose of limiting the claimed invention, independent of the combinations of features in the embodiments and/or the claims. It is explicitly stated that all range specifications or specifications of groups of units disclose every possible intermediate value or subgroup of units for the purpose of the original disclosure as well as for the purpose of limiting the claimed invention, in particular also as the limit of a range specification.

REFERENCE NUMBER LIST

10 (Inverse) crimping device
12 Terminal
14 Core
16 Crimp anvil
18 Crimper
20 To-be-reshaped regions
22 Cutting blade
24 Infeed belt
26 Stop
28 Base plate
30 Screw
32 Pedestal
34 Crimper region
36 Drive unit
38 Support region
40 Guide plate
42 Slot
44 Guide bolt
45 Spring
46 Guide slot
48 Core insertion opening
50 Stop portion
52 Infeed-belt transport device
54 Core feed device
56 Crimping system
58 Conventional crimping device
60 Multi-core cable
70 Crimp anvil
72 Terminal
74 Crimper

76 Carrier
78 Drive unit
80 Infeed-belt guide device
82 Core

The invention claimed is:

1. A crimping device for crimping a terminal onto a core, the crimping device including:

a crimp anvil configured to support the terminal in or on the crimp anvil;

a crimper configured to reshape to-be reshaped regions of the terminal while the terminal is supported on the crimp anvil; and an infeed-belt guide device configured to guide an infeed belt that holds the terminal;

wherein:

the crimp anvil is configured to be moved together with the terminal toward the crimper while the terminal is supported in or on the crimp anvil and the to-be reshaped regions of the terminal are being reshaped, the crimper is configured to remain stationary with respect to a pedestal that supports the crimping device on a surface while the to-be reshaped regions of the terminal are being reshaped, the infeed-belt guide device is configured to be moved at least temporarily together with the crimp anvil toward the crimper before and/or while the to-be reshaped regions of the terminal are being reshaped, and the crimping device executes a first phase of the movement of the crimp anvil toward the crimper and a second phase of the movement of the crimp anvil toward the crimper;

wherein:

in the first phase of the movement of the crimp anvil toward the crimper, no relative movement takes place between the infeed-belt guide device and the crimp anvil, and/or in the second phase of the movement of the crimp anvil toward the crimper, no relative movement takes place between the infeed-belt guide device and the crimper.

2. A crimping device for crimping a terminal onto a core, the device including:

a crimp anvil;

a crimper that is stationary with respect to a pedestal that supports the crimping device on a surface; and an infeed-belt guide device;

wherein the crimp anvil and the crimper are configured such that the core and the terminal held on an infeed belt are disposable in an intermediate space between the crimp anvil and the crimper, in which the crimp anvil, the terminal, the core, and the crimper are disposed overlapping in one direction in this order, the crimp anvil is configured to be moved toward the crimper together with the terminal while the terminal is supported in or on the crimp anvil and to-be reshaped regions of the terminal are being reshaped, the infeed-belt guide device is configured to be moved at least temporarily together with the crimp anvil toward the crimper before and/or while the to-be reshaped regions of the terminal are being reshaped, and the crimping device executes a first phase of the movement of the crimp anvil toward the crimper and a second phase of the movement of the crimp anvil toward the crimper;

wherein:

in the first phase of the movement of the crimp anvil toward the crimper, no relative movement takes place between the infeed-belt guide device and the crimp anvil, and/or in the second phase of the movement of the crimp anvil toward the crimper, no relative movement takes place between the infeed-belt guide device and the crimper.

3. The crimping device according to claim I, wherein:

the crimper is configured such that, before and/or while the to-be reshaped regions of the terminal are being reshaped, the crimper is stationary with respect to a fixed base, and/or a drive unit is configured to move the crimp anvil toward the crimper, and/or while the to-be reshaped regions of the terminal are being reshaped, the crimp anvil is configured to be moved toward the crimper from a first anvil position to a second anvil position.

4. The crimping device according to claim 3, further including:

a cutting blade configured to separate the terminal held on the infeed belt from the infeed belt, wherein:

the infeed-belt guide device is provided in or on the cutting blade in the form of a guide slot, in which the infeed belt is guidable, and the cutting blade is movable with respect to the crimp anvil between a first relative position, at which the terminal is disposed on the infeed belt held between the crimp anvil and the crimper, and a second relative position, at which the terminal is supported on the crimp anvil and is separated from the infeed belt.

5. The crimping device according to claim 4, wherein:

in the state in which the cutting blade is located in the first relative position with respect to the crimp anvil, the cutting blade is configured to be in its lowest position with respect to the crimp anvil, and/or in the first anvil position and/or prior to reaching the second anvil position, the crimp anvil is configured to support the terminal, and/or the cutting blade is configured to be guided on the crimp anvil.

6. The crimping device according to claim 4, further comprising:

a stop arranged to be contacted by the cutting blade as the cutting blade moves toward the crimper, the stop being stationary with respect to the crimper, wherein the cutting blade and the stop are configured such that:

in a first portion of relative movement of the crimp anvil toward the crimper, the cutting blade, while being located in the first relative position with respect to the crimp anvil, is moved toward the stop and then abuts on the stop, and alter abutting on the stop, the cutting blade causes the terminal to separate from the infeed belt in a second portion of the relative movement of the crimp anvil toward the crimper owing to relative movement between the crimp anvil and the cutting blade that causes the cutting blade to be moved to the second relative position.

7. The crimping device according to claim 6, wherein the cutting blade and the stop are configured such that:

when the cutting blade comes into contact with the stop as the crimp anvil moves towards the crimper, the terminal is fixed between the crimp anvil and the crimper.

8. The crimping device according to claim 1, wherein:

the crimp anvil and the crimper are configured such that the terminal to be crimped and to be inserted into the device is opened toward the crimper prior to the crimping process, and/or the crimp anvil and the crimper are configured such that the core and the terminal are disposable in an intermediate space between the crimp anvil and the crimper, wherein the crimp anvil, the terminal, the core, and the crimper are disposed overlapping in one direction in this order, and/or the crimp anvil is disposed vertically above the crimper.

9. The crimping device according to claim 1, wherein the crimping device is configured such that:

in the second phase of the movement, the terminal is separated from the infeed belt, and/or the to-be reshaped regions of the terminal are reshaped in the first and second phases or only in the second phase, and/or the reshaping of to-be reshaped regions of the terminal is completed with the end of the second phase.

10. A crimping system for crimping first and second terminals on first and second cores, respectively, of a multi-core cable, the crimping system including:

a first crimping device according to claim 1, the device being configured to crimp the first terminal onto the first core of the multi-core cable; and a second crimping device for crimping the second terminal onto the second core of the multi-core cable, the second crimping device including:

a crimp anvil configured to support the second terminal while to-be reshaped regions of the second terminal are being reshaped, a crimper configured to reshape the to-be reshaped regions of the second terminal supported on the crimp anvil while the crimp anvil moves toward the crimper wherein the second device is configured such that:

the crimp anvil with the second terminal supportable in or on the crimp anvil is stationary with respect to a fixed base while the to-be reshaped regions of the second terminal are being reshaped, wherein the crimping system is configured such that:

the first terminal is crimpable onto the first core by the first crimping device according to claim 1 while the to-be reshaped regions of the terminal are being reshaped, the second terminal is crimpable onto the second core by the second crimping device while the to-be reshaped regions of the second terminal are being reshaped, and the multi-core cable is not rotated about its longitudinal axis between the re-shaping of the first terminal and the re-shaping of the second terminal.

11. A method of crimping one or more terminals on one or more cores, including:

providing and feeding a first terminal held on an infeed belt;

providing a first core onto which the first terminal is to be crimped;

moving a first crimp anvil together with the first terminal toward a stationary first crimper while the first terminal is supported in or on the first crimp anvil to re-shape to-be reshaped regions of the first terminal; and at least temporarily moving an infeed-belt guide device, in which the infeed belt is guided together with the first crimp anvil toward the stationary first crimper before and/or while the to-be reshaped regions of the first terminal are being reshaped, wherein:

in a first phase of the movement of the first crimp anvil toward the stationary first crimper, no relative movement takes place between the infeed-belt guide device and the first crimp anvil, and/or in a second phase of the movement of the first crimp anvil toward the stationary first crimper, no relative movement takes place between the infeed-belt guide device and the stationary first crimper.

12. The method according to claim 11, further comprising:

upstream or downstream of the first crimp anvil, crimping a second terminal onto a second core by moving a second crimper toward a second crimp anvil in which the second terminal is supported, wherein a multi-core cable that contains the first core and the second core has a longitudinal axis and is not rotated about the longitudinal axis between the re-shaping of the first terminal and the re-shaping of the second terminal.

13. The method according to claim 11, wherein:

the first terminal k preformed, and/or the first terminal includes a crimp region, in which the to-be reshaped and not-to-be reshaped regions are disposed, and a contact region configured to form a plug, pin, or a socket.

14. The crimping device according to claim 1, wherein the crimper is disposed vertically below the crimp anvil.

15. The crimping device according to claim 4, wherein the crimp anvil and the crimper are configured such that:

the terminal to be crimped and to be inserted into the crimping device is opened toward the crimper prior to re-shaping the to-be reshaped portions of the terminal, and the core and the terminal are disposable in an intermediate space between the crimp anvil and the crimper such that the crimp anvil, the terminal, the core, and the crimper are disposed overlapping in one direction in this order, and wherein the crimp anvil is disposed vertically above the crimper.

16. The crimping device according to claim 15, further comprising:

a stop arranged to be contacted by the cutting blade as the cutting blade moves toward the crimper, the stop being stationary with respect to the crimper, wherein the cutting blade and the stop are configured such that:

in a first portion of relative movement of the crimp anvil toward the crimper, the cutting blade, while being located in the first relative position with respect to the crimp anvil, is moved toward the stop and then abuts on the stop, and after abutting on the stop, the cutting blade causes the terminal to separate from the infeed belt in a second portion of the relative movement of the crimp anvil toward the crimper owing to relative movement between the crimp anvil and the cutting blade that causes the cutting blade to be moved to the second relative position.

17. The crimping device according to claim 16, wherein the cutting blade and the stop are configured such that:

when the cutting blade comes into contact with the stop as the crimp anvil moves towards the crimper, the terminal is fixed between the crimp anvil and the crimper.

18. The crimping device according to claim 17, wherein:

in the second phase of the movement, the terminal is separated from the infeed belt, the to-be-shaped portions of the terminal are re-shaped in the first and second phases or only in the second phase, and the re-shaping of the to-be-shaped portions of the terminal is completed at an end of the second phase.

19. The crimping device according to claim 18, wherein:

in the state in which the cutting blade is located in the first relative position with respect to the crimp anvil, the cutting blade is configured to be in its lowest position with respect to the crimp anvil, and in the first anvil position and/or prior to reaching the second anvil position, the crimp anvil is configured to support the terminal, and the cutting blade is configured to be guided by the crimp anvil.

* * * * *